US005617808A

United States Patent [19]

Robinson

[11] Patent Number: 5,617,808

[45] Date of Patent: Apr. 8, 1997

[54] PORTABLE FOAM TUBE BOAT WITH FLEXIBLE SHELL

[76] Inventor: Glenn R. Robinson, P.O. Box 8125, Portland, Me. 04104

[21] Appl. No.: 676,003

[22] Filed: Jul. 5, 1996

Related U.S. Application Data

[63] Continuation-in-part of Ser. No. 545,133, Oct. 19, 1995, abandoned, which is a continuation-in-part of Ser. No. 404,944, Mar. 15, 1995, abandoned, which is a continuation-in-part of Ser. No. 223,177, Apr. 5, 1994, abandoned.

[51] Int. Cl.[6] ..... B63B 43/14

[52] U.S. Cl. ..... 114/123; 114/357

[58] Field of Search ..... 114/343, 345, 114/357, 123, 61; 441/35, 65, 129, 130, 131, 132

[56] References Cited

U.S. PATENT DOCUMENTS

| | | | |
|---|---|---|---|
| 3,103,018 | 9/1963 | Eldred | 114/357 |
| 3,435,470 | 4/1969 | Krenzier | 114/357 |
| 3,593,354 | 7/1971 | Carter | 114/357 |
| 4,032,689 | 6/1977 | Johnson et al. | 114/357 |
| 5,036,789 | 8/1991 | Kelly et al. | 114/357 |
| 5,282,436 | 2/1994 | Hansen | 114/357 |

*Primary Examiner*—Stephen Avila
*Attorney, Agent, or Firm*—Chris A. Caseiro; Thomas L. Bohan

[57] ABSTRACT

A portable boat for all commercial and recreational uses, with particular application to shallow water situations. The boat comprises a multi-tube flotation perimeter hull constructed of connected, epoxy-laminated foam cores and totally encased with a vinyl polyester fabric; a reinforced floor portion and, a full rear transom means. This water craft is strong, yet flexible, unsinkable and virtually impervious to punctures and abrasion damage. These positive benefits are accomplished without sacrificing the advantages of light-weight construction and ease of transportation.

18 Claims, 4 Drawing Sheets

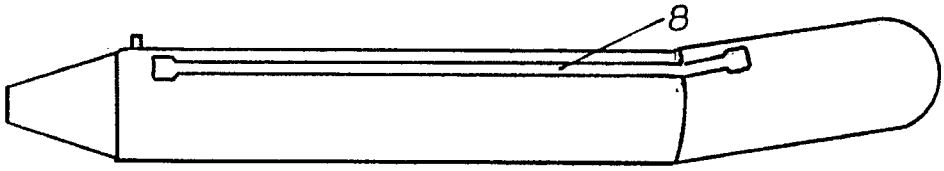
FIG.3
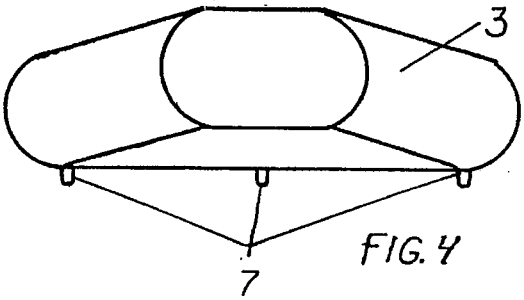
FIG. 4
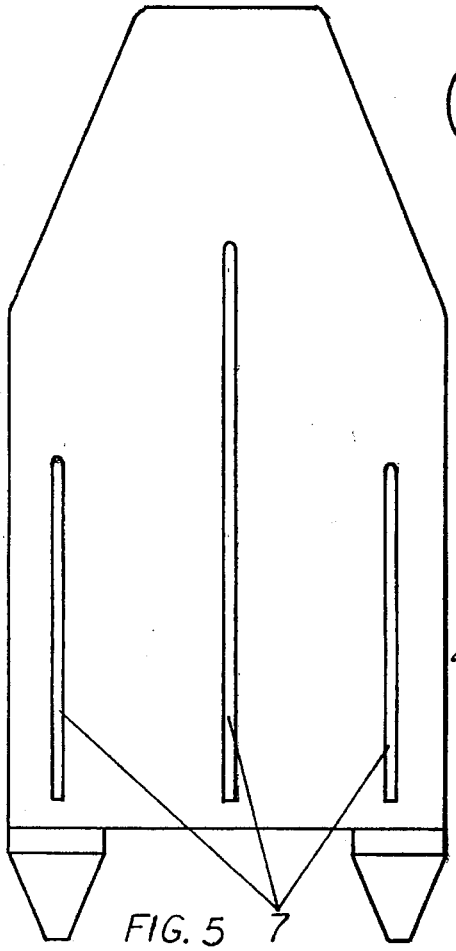
FIG. 5
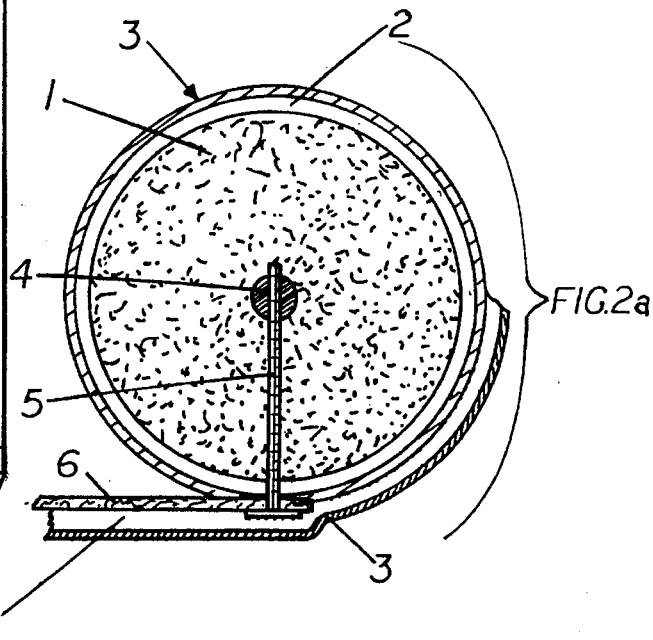

PORTABLE FOAM TUBE BOAT WITH FLEXIBLE SHELL

This is a continuation-in-part of application Ser. No. 545,133, filed Oct. 19, 1995, now abandoned, which was a continuation-in-part of abandoned application Ser. No. 404, 944, filed Mar. 15, 1995, which was a continuation-in-part of abandoned application Ser. No. 223,177, filed Apr. 5, 1994.

FIELD OF INVENTION

This invention relates superficially to the inflatible boats currently on the market, but has a unique internal structural core made of unsinkable foam covered with a flexible epoxy material laminate.

BACKGROUND OF INVENTION

The inflatable boats now in use by commercial and recreational divers, who frequent shallower waters, reefs and other rocky or cluttered marine areas, are often susceptible to potentially disasterous contact punctures. Consequently, a boat that incorporates a virtually puncture-proof construction, while retaining the positive and desirable aspects of standard inflatable, will provide a safer, stronger, reinforced watercraft with unlimited applications. Therefore, the functional purpose of this invention is to provide both the general and specialized consumer with a safe, stable and affordable boat that cannot deflate, collapse or sink like those boats now in existence.

COMPONENTS BY NUMBER

1. Expanded polystyrene foam tube
2. Laminating epoxy system in flexible mixture
3. Polyester reinforced vinyl fabric
4. Polyvinyl chloride reinforcing rod
5. 8" self-threading screws
6. ½" oak plywood floor
7. 2"0 wide polyvinyl chloride strip
8. Polyester reinforced vinyl grab rails
9. Rowing seat, wood
10. Reinforced plywood transom

BRIEF DESCRIPTION OF THE DRAWINGS

FIGS. 2 & 2A are cross section views illustrating the positioning of the foam core, flexible epoxy laminate, vinyl covering, reinforcement rod, and floor with attchment means.

FIG. 3 is a perspective view of the side of the boat

FIG. 4 is a perspective view of the bottom portion of the boat

FIG. 5 is a perspective view of the bow of the foam boat of the present invention.

DESCRIPTION OF PREFERRED EMBODIMENTS

Figure 1:
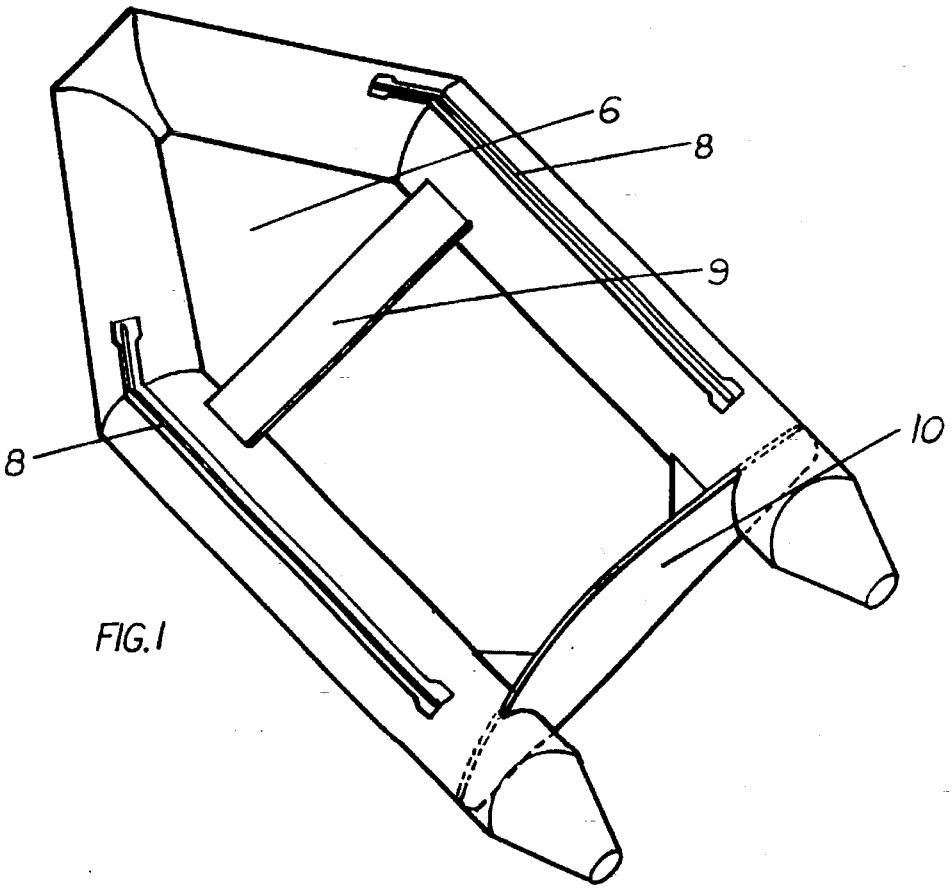
FIG. 1 is a perspective view of the entire top portion of the boat.

The inflatable boats currently available for commercial and recreational uses are routinely exposed to damages from continuous impact with rocks, barnacles, abrasive structures and obstacles and similar risks inherent in the various shallow water uses for which this type of craft is designed.

Of particular interest to those involved in harvesting sea urchins, is the fact that the craft of the present invention replaces with solid foam elements the primary inflatable pontoons that are susceptible to catastrophic failure, which can lead to sinking of the craft. The elimination of the inflatable pontoons also minimizes the chance that the craft can be stolen as a result of the deflation of the craft for the purpose of storing it in a small space.

The present invention eliminates the flaws in the prior inflatable boats through the use of cylindrical members including a solid foam perimeter hull unit 1 that is covered with a flexible protective layer 2. The solid foam element 1 may be fabricated of generally available foam materials including, but not limited to, closed-cell foams such as polystyrene foam, polyethylene foam, and polyurethane foam. The solid foam perimeter hull unit I may be fabricated by layering one or more foam types together to create the desired cylindrical diameter. The solid foam perimeter is preferably formed of a plurality of foam elements placed together so as to create the sides and the bow of the craft. The foam elements 1 may be covered directly with the flexible protective layer 2.

The flexible protective layer 2 is formed of a viscoelastic material that may, but that does not have to, include reinforcing material such as a fabric mesh or cloth, fabric particles, or other reinforcing components. The mesh fabric may be formed of polyester, vinyl, nylon, glass, or other suitable material. The viscoelastic material may be a flexiblized epoxy formulation, polyurethane, or the like. Additional protection that may also enhance the overall appearance of the boat may be provided by a secondary outer layer 3 that may cover a portion or the entirety of the protective layer 2. The secondary outer layer 3 may provide greater water impermeability and protection against ultraviolet degradation. The secondary outer layer 3 may be fabricated as a reinforced viscoelastic laminate. Preferably, that laminate is sufficiently strong to withstand the stresses typically experienced in relatively shallow ocean water. The laminate must be fabricated so as to localize any damage caused by piercing objects and/or by blunt forces. It has been determined that a polyester-fabric-reinforced polyvinyl chloride laminate produces a suitable design for the secondary outer layer 3. Other suitable materials may be used to form the secondary outer layer 3 including, but not limited to, the use of glass, vinyl, or nylon reinforcement in combination with a relatively strong viscoelastic material, such as epoxy or a hardened polyurethane.

In an alternative design of the boat, the protected foam units that form the structural elements of the boat may be combined as a laminate including one or more foam elements layered together, application of the flexible protective layer 2 that includes the fabric mesh over the foam unit, and then application of the viscoelastic material. In that alternative design, it is preferable to wrap the mesh substantially around the foam pieces so as to ensure that various components of the boat will be firmly secured together. The secondary outer layer 3 may then be applied. The result is a craft that is sturdy, safe and unsinkable.

FIG. 1. Illustrates the external structure of the invention, including a reinforced stern transom 10, and safety grab rails 8.

Figure 2:
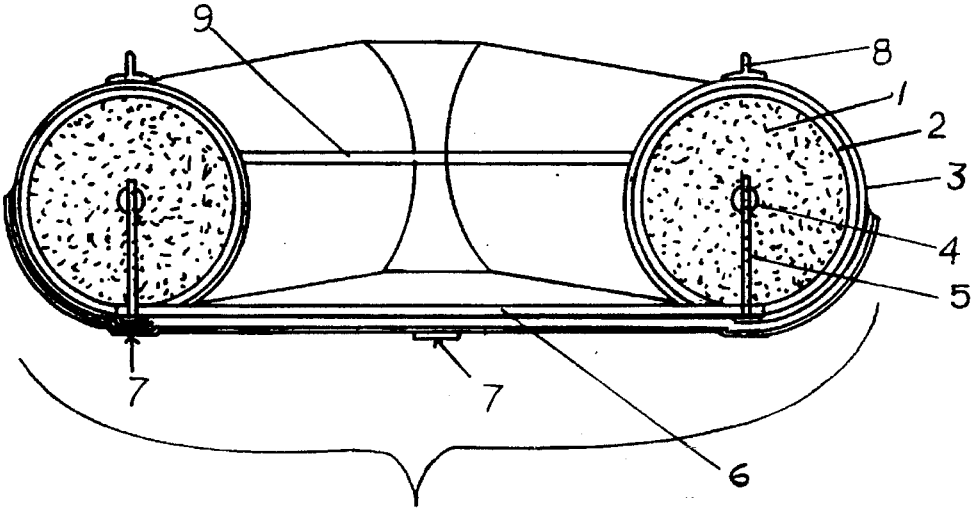

FIGS. 2 & 2A. Illustrate a cross section of the invention displaying the foam elements 1 with a reinforcement rod 4, which may be fabricated of wood, metal, or a viscoelastic material such as PVC, running through the longitudinal center of the foam core. The tubing and core units are then covered with a highly puncture resistant two-part mixture of epoxy laminate 2. A final protective vinyl covering is then applied to the flotation core unit. (No. 3). A floor 6 of the craft, which may be fabricated of metal, plywood, or a reinforced viscoelastic such as fiberglass, is attached to the reinforcement rod 4 by attachment means such as self-threading screws 5, or by an eye-bolt, the eye of which is placable about and retains the reinforcement rod 4, and the base of which is affixable to the floor 6 of the craft. The floor 6 may be covered with the secondary protective layer 3 as desired, or as required by the particular flooring material selected. A plurality of strips 7 are positioned along the longitudinal axis of the craft on the side of the floor 6 to be in contact with the water. They may be separately affixed to, or preferably formed as an integral part of the floor 6. The strips 7 act as stand-offs to minimize damage to the craft hull when the craft moves over rough surfaces. The strips 7 may be fabricated of metal, wood, or a viscoelastic material. When the floor 6 is made of fiberglass, the strips 7 may also be formed of fiberglass and integral to the floor fabrication.

In an alternative embodiment, the foam unit 1 may be attached to the floor 6 by placing the alternative fabric mesh of the flexible protective layer 2 that is wrapped around the foam unit 1 onto a portion of the floor 6 and bonding the mesh thereto. The mesh may be bonded to the floor 6 using the protective viscoelastic material, such as a polyurethane spray coat. Through this design and other coating configurations, the number of fastening screws 5 that act as attachment means for the reinforcement rod 4 can be minimized to the point that one, likely none, are required. Such a design is also sufficiently strengthened by the combination of components indicated that the reinforcement rod 4 becomes an optional strengthening element. A side view of the water craft is illustrated by FIG. 3, with FIG. 4 providing a perspective view from the bow. FIG. 5 illustrates the floor portion as viewed from its external, underside.

Figure 6:
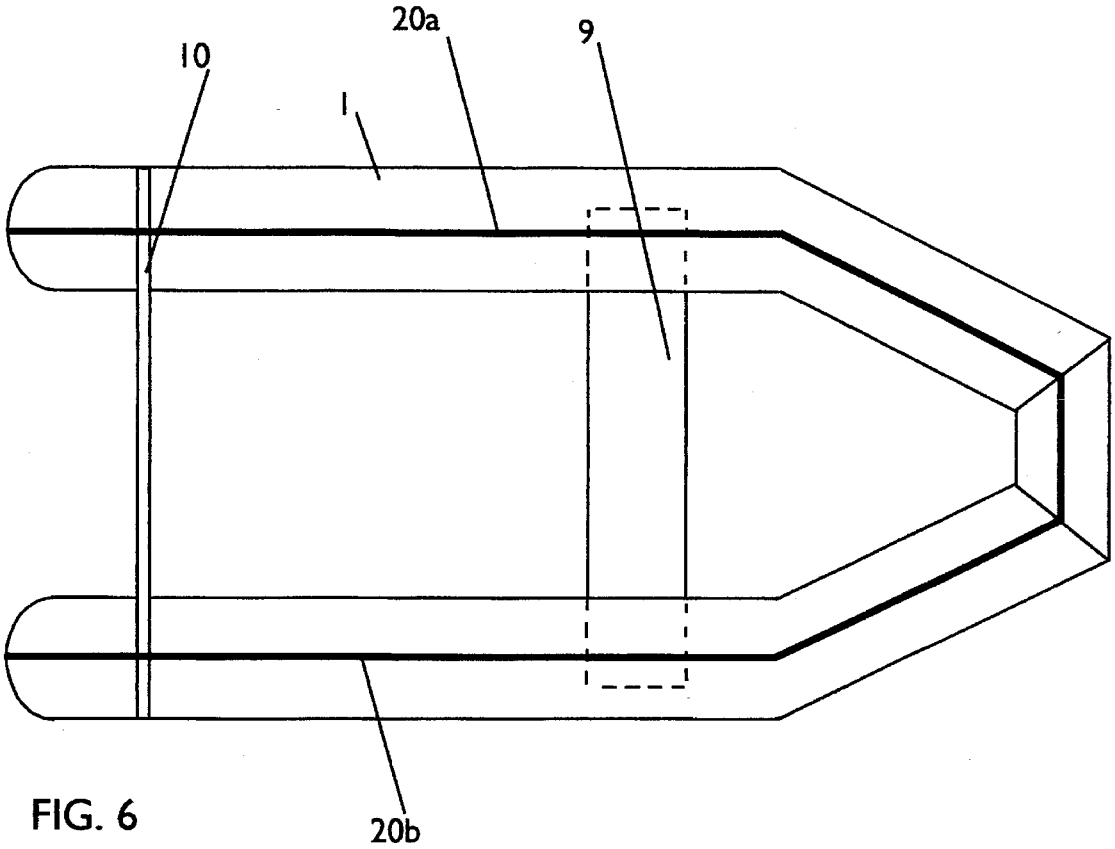
FIG. 6 is a top view of the foam boat of the present invention with an alternative reinforcing means shown positioned within the foam hull.
Figure 7:
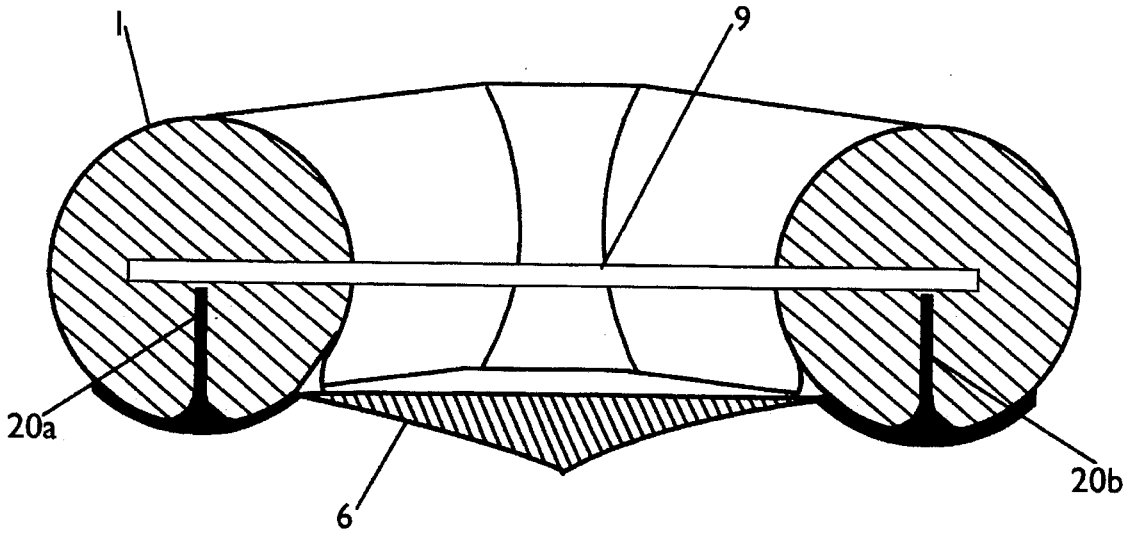
FIG. 7 is a cross-sectional view of an alternative reinforcing means for the foam hull of the present invention.

An alternative optional reinforcing means is illustrated in FIGS. 6 and 7. In particular, as previously indicated, the floor 6, which is the bottom portion of the hull of the boat, may be fabricated of a non-metallic material, including, but not limited to fiber-reinforced plastics such as fiberglass, non-reinforced plastics, such as acrylonitrile-butadiene styrene (ABS), or combinations of materials, such as LURAN S(TM), a composite available from BASF. Of course, it is to be understood that any material capable of withstanding the stresses experienced by a boat hull can be used to form that section of the watercraft of the present invention. When fabricated of such a material, the optional reinforcing means may be formed at the same process as when the floor 6 is formed by "folding" the floor component into reinforcing flanges 20*a* and 20*b* that may extend longitudinally through a portion of the foam unit 1 that is the primary hull of the boat, or substantially entirely through the foam units 1, as shown in FIG. 6. The fabrication of such a unitary piece is well known to those skilled in the art of fiber-reinforced components.

An advantage in providing such a unitary reinforcing element is that the difficulty in using the plurality of reinforcing components shown in FIG. 2 is eliminated, e.g., interconnective failure will not occur. Moreover, the unitary reinforcing flanges 20*a* and 20*b* are easier and faster to construct in conjunction with the fabrication of the floor 6, they have increased impact resistance and greater coupling to the interior of the foam units 1, and they permit more efficient placement of the seat 9 into the foam units 1. While it is to be understood that the present invention may be fabricated without reinforcement within the foam units 1 due to sufficient adhesion between the floor 6 and the protective layer covering the foam units 1, use of reinforcement of the type shown in FIGS. 6 and 7 will enhance the security of that coupling. The flanges 20*a* and 20*b* act as elongated rods that may be used to replace the reinforcing rods and screws shown in FIG. 2.

Because the expanded polystyrene foam core unit 1 can be chipped or dented, additional structural integrity is achieved by inserting a PVC reinforcement rod 4 through the longitudinal center of the core unit, and then covering the entire reinforced core unit with a hard, yet flexible two-part activator and resin epoxy mixture. The completed reinforced, laminated core unit is finally covered with a protective polyester reinforced vinyl fabric.

What is claimed is:

1. An unsinkable, portable watercraft for commercial and recreational use, said watercraft comprising:

(a) a perimeter hull made of two or more cylindrical members, wherein two of said two or more cylindrical members are substantially parallel members and form port and starboard sections of said perimeter hull, and wherein a portion of said two or more cylindrical members taper inwardly from said substantially parallel members so as to form a bow section of said perimeter hull;

(b) a floor connected to said two or more cylindrical members affixed at a bottom tangential location of each of said two or more cylindrical members; and (c) a transom connected to said floor and to said substantially parallel members so as to form a stern of said watercraft, wherein each of said two or more cylindrical members is formed substantially of one or more solid foam pieces, and an outer shell substantially encapsulating said solid foam pieces, and wherein said two or more cylindrical members are floatational.

2. The watercraft as claimed in claim 1 further comprising a reinforcing rod within each of said cylindrical members, wherein said reinforcing rod is substantially horizontally oriented with respect to said one or more solid foam pieces each of said two or more cylindrical members further adapted to receive and hold one or more fasteners, wherein said one or more fasteners attach said reinforcing rod to said floor, said fasteners being substantially vertically oriented with respect to said reinforcing rod.

3. The watercraft as claimed in claim 1 wherein said outer shell substantially encapsulating said solid foam pieces is a flexible epoxy coating.

4. The watercraft as claimed in claim 1 wherein said outer shell substantially encapsulating said solid foam pieces is a polyurethane coating.

5. The watercraft as claimed in claim 1 wherein said cylindrical members include a single foam piece, wherein said single foam piece is polyethylene foam.

6. The watercraft as claimed in claim 2 wherein said reinforcing rod is PVC.

7. The watercraft as claimed in claim 3 wherein said outer shell substantially encapsulating said solid foam pieces includes a reinforcing mesh fabric forming part of said flexible epoxy coating.

8. The watercraft as claimed in claim 7 wherein said reinforcing mesh fabric is a vinyl/polyester mesh.

9. A portable watercraft for commercial and recreational use, said watercraft comprising:

(a) a perimeter hull made of two or more cylindrical members, wherein two of said two or more cylindrical members are substantially parallel members and form port and starboard sections of said perimeter hull, wherein a portion of said two or more cylindrical members taper inwardly from said substantially parallel members so as to form a bow section of said perimeter hull, and wherein each of said cylindrical members includes a reinforcing rod;

(b) a floor connected with a plurality of fasteners to said reinforcing rod of each of said two or more cylindrical members at a bottom tangential location of each of said two or more cylindrical members; and (c) a transom connected to said floor and to said substantially parallel members so as to form a stern of said watercraft, wherein each of said two or more cylindrical members is formed substantially of a layering of two solid foam pieces, and a flexible protective layer substantially encapsulating said solid foam pieces, wherein said flexible protective layer includes a mesh fabric reinforcement and a viscoelastic coating, wherein said two or more cylindrical members are floatational.

10. The watercraft as claimed in claim 9 wherein a first foam piece of said two solid foam pieces is a polystyrene foam and a second foam piece of said two solid foam pieces is a polyethylene foam.

11. The watercraft as claimed in claim 10 wherein said mesh fabric reinforcement is a nylon mesh fabric.

12. The watercraft as claimed in claim 11 wherein said nylon mesh fabric wraps substantially around said two solid foam pieces.

13. The watercraft as claimed in claim 12 wherein said viscoelastic coating is a polyurethane coating.

14. The watercraft as claimed in claim 9 wherein said mesh fabric reinforcement is a polyester mesh fabric.

15. The watercraft as claimed in claim 9 further comprising a secondary outer protective layer encapsulating said flexible protective layer.

16. The watercraft as claimed in claim 15 wherein said secondary outer protective layer is formed as a laminate including a polyester reinforcement within a polyvinyl chloride coating.

17. A portable watercraft for commercial and recreational use, said watercraft comprising:

(a) a perimeter hull made of two or more cylindrical members, wherein two of said two or more cylindrical members are substantially parallel members and form port and starboard sections of said perimeter hull, wherein a portion of said two or more cylindrical members taper inwardly from said substantially parallel members so as to form a bow section of said perimeter hull;

(b) a floor connected to each of said two or more cylindrical members at a bottom tangential location of each of said two or more cylindrical members, wherein said floor includes reinforcing means located within said two or more cylindrical members; and (c) a transom connected to said floor and to said substantially parallel members so as to form a stern of said watercraft, wherein each of said two or more cylindrical members is formed substantially of one or more solid foam pieces, and an outer shell substantially encapsulating said solid foam pieces, wherein said two or more cylindrical members are floatational.

18. The watercraft as claimed in claim 17 wherein said floor is fabricated of a fiber-reinforced viscoelastic material and said reinforcing means includes reinforcing flanges extending from said floor up into said two or more cylindrical members.

* * * * *